US005336845A

United States Patent [19]

Lace, Sr.

[11] Patent Number: 5,336,845

[45] Date of Patent: Aug. 9, 1994

[54] PICK-UP ASSEMBLY FOR A STRINGED MUSICAL INSTRUMENT

[75] Inventor: Donald A. Lace, Sr., Huntington Beach, Calif.

[73] Assignee: Actodyne General, Inc., Huntington Beach, Calif.

[21] Appl. No.: 145,489

[22] Filed: Oct. 29, 1993

Related U.S. Application Data

[63] Continuation of Ser. No. 396, Jan. 4, 1993.

[51] Int. Cl.[5] ..... G10H 3/18

[52] U.S. Cl. ..... 84/726

[58] Field of Search ..... 84/725, 726

[56] References Cited

U.S. PATENT DOCUMENTS

| | | |
|---|---|---|
| Re. 325,520 | 10/1987 | Lace . |
| 2,089,171 | 8/1937 | Beauchamp . |
| 2,119,584 | 6/1938 | Knoblaugh . |
| 2,175,325 | 10/1939 | Sunshine . |
| 2,209,016 | 7/1940 | Dickerson . |
| 2,294,861 | 9/1942 | Fuller . |
| 2,445,046 | 7/1948 | Tinkham . |
| 2,557,754 | 6/1951 | Morrison . |
| 2,567,570 | 9/1951 | McCarty . |
| 2,573,254 | 10/1951 | Fender . |
| 2,612,541 | 9/1952 | De Armond . |
| 2,683,388 | 7/1954 | Keller . |
| 2,725,778 | 12/1955 | Cronwell . |
| 2,764,052 | 9/1956 | McBride . |
| 2,817,261 | 12/1957 | Fender . |
| 2,892,371 | 6/1959 | Butts . |
| 2,896,491 | 7/1959 | Lover . |
| 2,909,092 | 10/1959 | De Armond et al. . |
| 2,911,871 | 11/1959 | Schultz . |
| 2,968,204 | 1/1961 | Fender . |
| 2,976,755 | 3/1961 | Fender . |
| 3,066,567 | 12/1962 | Kelley, Jr. . |
| 3,183,296 | 5/1965 | Miessner . |
| 3,236,930 | 2/1966 | Fender . |
| 3,249,677 | 5/1966 | Burns et al. . |
| 3,290,424 | 12/1966 | Fender . |
| 3,417,268 | 12/1968 | Lace . |
| 3,483,303 | 12/1969 | Warner . |
| 3,530,228 | 9/1970 | Scherer . |
| 3,535,968 | 10/1970 | Rickard . |
| 3,541,219 | 11/1970 | Abair . |
| 3,571,483 | 3/1971 | Davidson . |
| 3,588,311 | 6/1971 | Zoller . |
| 3,602,627 | 8/1971 | McCammon . |
| 3,657,461 | 4/1972 | Freeman . |
| 3,668,295 | 6/1972 | Broussard . |
| 3,711,619 | 1/1973 | Jones et al. . |
| 3,715,446 | 2/1973 | Kosinski . |
| 3,725,561 | 4/1973 | Paul . |
| 3,902,394 | 9/1975 | Stich . |
| 3,911,777 | 10/1975 | Rendell . |
| 3,916,751 | 11/1975 | Stich . |
| 3,962,946 | 6/1976 | Rickard . |
| 3,983,777 | 10/1976 | Bartolini . |
| 3,983,778 | 10/1976 | Bartolini . |
| 4,026,178 | 5/1977 | Fuller . |
| 4,056,255 | 11/1977 | Lace . |
| 4,133,243 | 1/1979 | DiMarzio . |
| 4,184,399 | 1/1980 | Zuniga . |
| 4,220,069 | 9/1980 | Fender . |
| 4,222,301 | 9/1980 | Valdez . |
| 4,268,771 | 5/1981 | Lace . |
| 4,269,103 | 5/1981 | Underwood . |
| 4,283,982 | 8/1981 | Armstrong . |

(List continued on next page.)

*Primary Examiner*—William M. Shoop, Jr.
*Assistant Examiner*—Jeffrey W. Donels
*Attorney, Agent, or Firm*—Daniel H. Bliss

[57] ABSTRACT

A dual coil pick-up assembly for a stringed musical instrument having a plurality of moveable strings includes a case having a longitudinal channel with first and second sections. The pick-up assembly also includes first and second magnet structures disposed in the first and second sections having opposite polarities and a coil structure disposed in the first and second sections of the channel for eliminating hum in the pick-up assembly due to stray magnetic fields.

20 Claims, 2 Drawing Sheets

U.S. PATENT DOCUMENTS 4,320,681 3/1982 Altilio .
4,364,295 12/1982 Stich .
4,372,186 2/1983 Aaroe .
4,379,421 4/1983 Nunan .
4,394,830 7/1983 Damiano .
4,433,603 2/1984 Siminoff .
4,442,749 4/1984 DiMarzio et al. .
4,463,648 8/1984 Fender .
4,472,994 9/1984 Armstrong .
4,501,186 2/1985 Ikuma .
4,524,667 6/1985 Duncan .
4,535,668 8/1985 Schaller .
4,580,481 4/1986 Schaller et al. .
4,624,172 11/1986 McDougall .
4,738,178 4/1988 Deering .
4,809,578 3/1989 Lace, Jr. ..... 84/725
4,854,210 8/1989 Palazzolo .
4,878,412 11/1989 Resnick .
4,941,389 7/1990 Wendler .
5,041,784 8/1991 Griebeler .
5,148,733 9/1992 Beller .
5,221,805 6/1993 Lace .

PICK-UP ASSEMBLY FOR A STRINGED MUSICAL INSTRUMENT

This is a continuation of U.S. patent application Ser. No. 08/000,396, filed Jan. 4, 1993.

BACKGROUND OF THE INVENTION

1. Field of the Invention

The present invention relates generally to musical instruments and, more particularly, to a dual coil pick-up assembly for use with stringed musical instruments.

2. Description of the Related Art

Generally, stringed musical instruments such as an electric guitar have electromagnetic sensors or pick-ups for sensing mechanical vibrations of the strings and converting such into electrical signals. The electrical signals from the electromagnetic sensors or pick-ups are amplified and modified and, ultimately, reconverted into acoustical energy to produce music and the like.

An example of such an electromagnetic sensor or pick-up is disclosed in U.S. Pat. No. 4,809,578, issued Mar. 7, 1989, entitled "Magnetic Field Shaping In An Acoustic Pick-up Assembly", the disclosure of which is hereby incorporated by reference. This patented pick-up assembly includes an elongated ferromagnetic case lined on the Interior thereof with planar permanent magnet pieces to present the same magnetic polarity into the interior thereof. The patented pick-up assembly also includes cores disposed in the interior of the case and having a plurality of coplanar, spaced, finger-like projections directed at the walls of the case. The walls and projections are permanently magnetized to a common magnetic polarity which will concentrate by magnetic repulsion flux into gaps between the projections. A coil is wound around the cores and the flux changes of these concentrated flux fields due to string motion induce a voltage in the coil. The coil has terminals connected to a socket in the stringed musical instrument for connection to an amplifier and speaker system.

Although the above patented pick-up assembly has worked well, it is typically situated among a mass of electronic equipment. As a result, the pick-up assembly may respond to stray magnetic fields and attenuate extraneous noise or hum which is undesired.

Moreover, musicians which play stringed musical instruments are desirous of having pick-ups which incorporate greater sensitivity to the full range of acoustic energy generated by the movement of such strings. However, such greater sensitivity often requires a balancing of the overall sensitivity of the pick-up and the attenuation of extraneous noise or hum. Thus, there is a need in the art to provide a pick-up which has greater sensitivity and substantially eliminates extraneous noise or hum.

SUMMARY OF THE INVENTION

It is, therefore, one object of the present invention to provide a dual coil pick-up assembly for a stringed musical instrument.

It is another object of the present invention to provide a dual coil pick-up assembly which substantially eliminates extraneous noise or hum.

It is yet another object of the present invention to provide a dual coil pick-up assembly which has a greater sensitivity.

It is still another object of the present invention to provide a "humbucking" or hum canceling pick-up assembly.

It is a further object of the present invention to provide a humbucking dual coil pick-up assembly which is less expense to manufacture and assemble.

To achieve the foregoing objects, the present invention is a dual coil pick-up assembly for a stringed musical instrument having a plurality of moveable strings. The pick-up assembly includes a case having means forming a longitudinal channel with first and second sections. The pick-up assembly also includes first magnet means disposed in the first section for producing a first magnetic polarity and second magnet means disposed in the second section for producing a second magnetic polarity opposite to the first magnetic polarity. The pick-up assembly further includes dual coil means disposed in the first and second sections for eliminating hum in the pick-up assembly due to stray magnetic fields.

One advantage of the present invention is that a dual coil pick-up assembly is provided for a stringed musical instrument. Another advantage of the present invention is that the dual coil pick-up assembly provides greater sensitivity while substantially eliminating extraneous noise. Yet another advantage of the present invention is that a dual coil pick-up assembly is provided which produces a humbucking effect by an arrangement of two coils such that the hum in one of the coils cancels out that in the other, while the signals in each coil add together to produce a stronger signal. A further advantage of the present invention is that a humbucking dual coil pick-up assembly is provided which is less expensive to manufacture and assemble by placing two coils in an end-to-end longitudinal arrangement.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
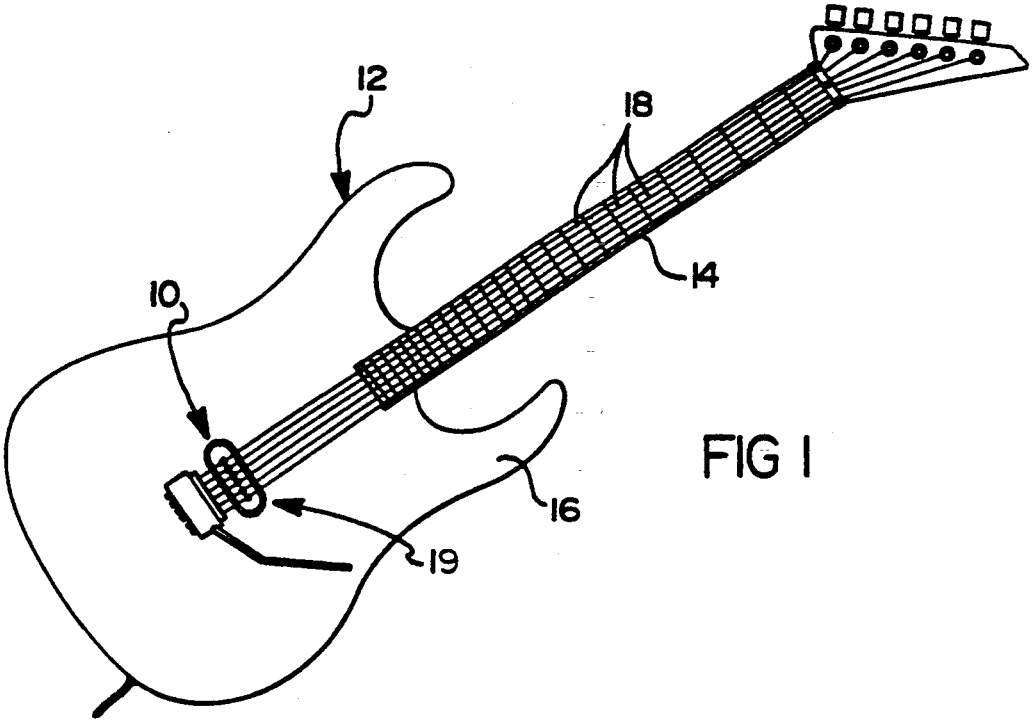
FIG. 1 is perspective view of a dual coil pick-up assembly, according to the present invention, illustrated in operational relationship to a stringed musical instrument.

Referring to the drawings and in particular to FIG. 1, a dual coil pick-up assembly 10, according to the present invention, is illustrated in operational relationship with a stringed musical instrument such as a guitar, generally indicated at 12. The guitar 12 is of the electric type and has a neck portion 14, a body portion 16, and a plurality of strings 18 extending along the neck and body portions 14 and 16. The pick-up assembly 10 is disposed beneath the strings 18 and mounted to the body portion 16 in a manner to be described.

Figure 2:
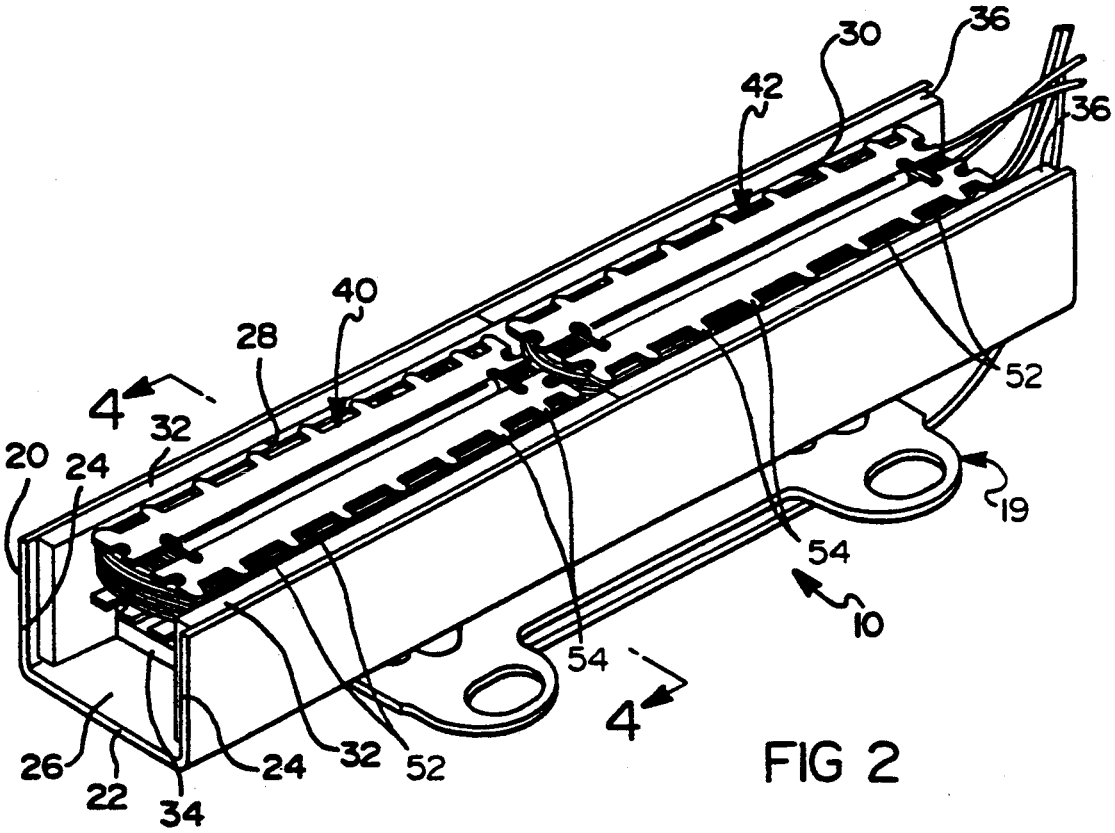
FIG. 2 is an enlarged perspective view of the dual coil pick-up assembly of FIG. 1.
Figure 3:
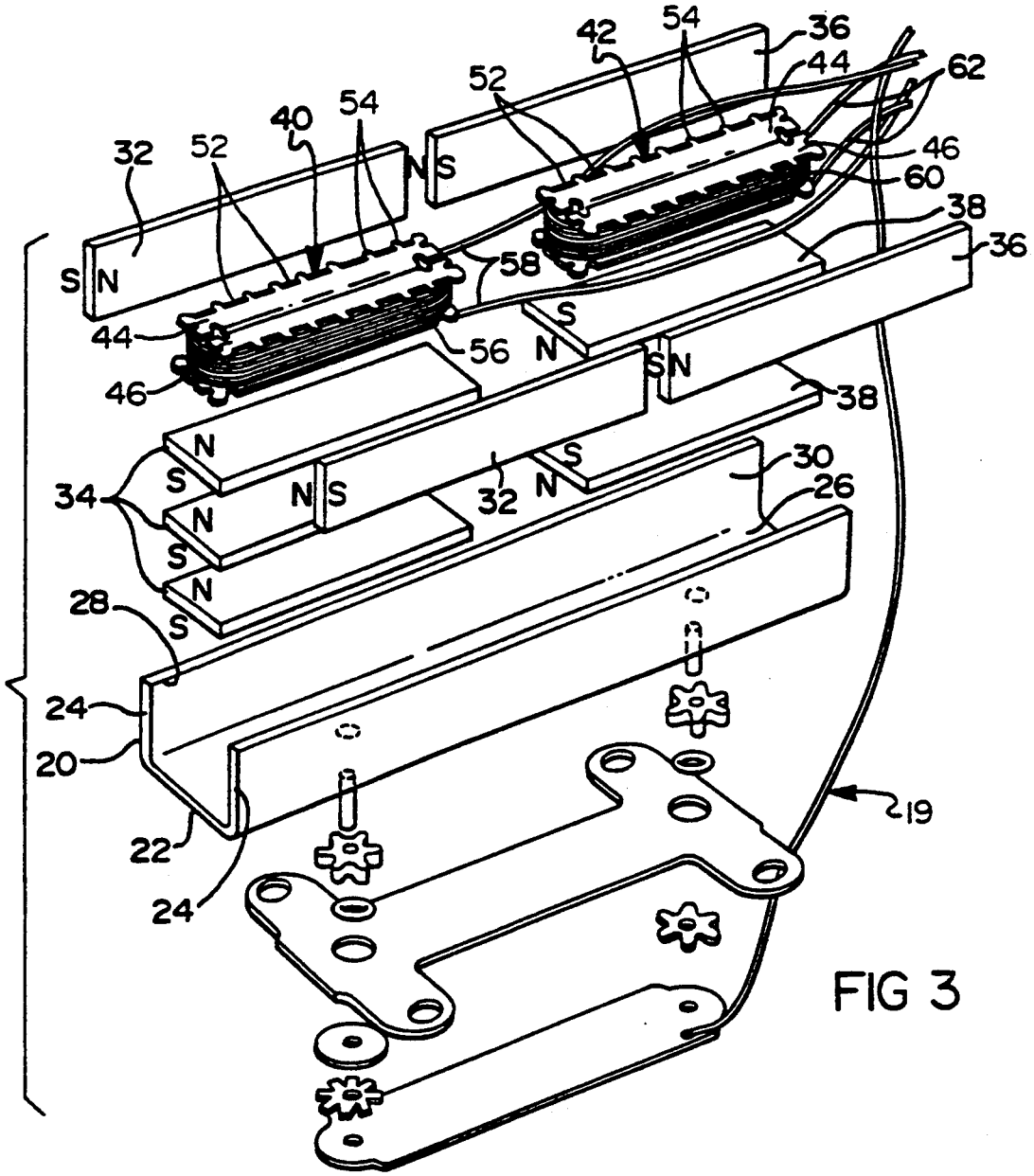
FIG. 3 is an exploded perspective view of the dual coil pick-up assembly of FIGS. 1 and 2.
Figure 4:
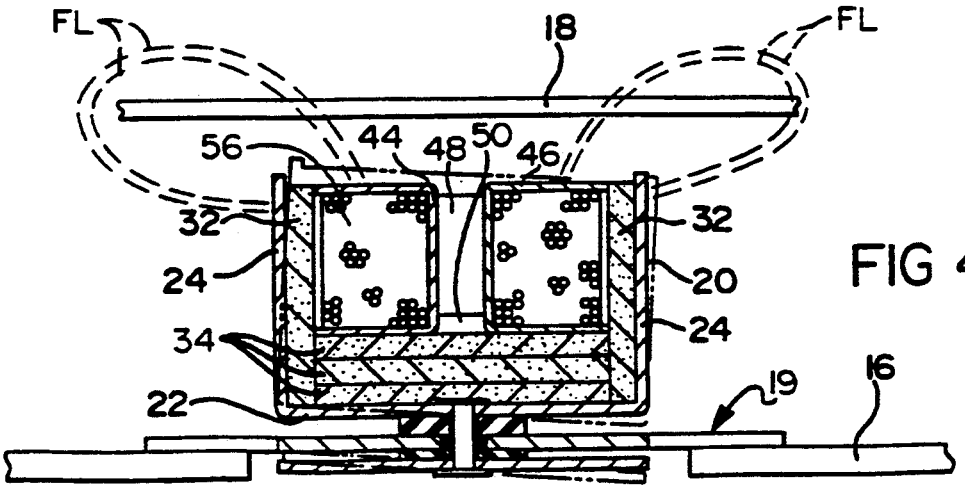
FIG. 4 is a sectional view taken along lines 4—4 of FIG. 2.

Referring to FIGS. 2 through 4, the dual coil pick-up assembly 10 includes a case 20 extending longitudinally and having a general "U" shape. The case 20 has a generally planar base wall 22 and a pair of generally planar side walls 24 substantially parallel to each other and perpendicular to the base wall 22 to form a longitudinal channel 26. The case 20 is made of a ferromagnetic material such as an iron based steel. The case 20 is divided into a first section 28 which has a first common magnetic polarity and a second section 30 which has a second common magnetic polarity opposite to that of the first section 28. It should be appreciated that the first section 28 and second section 30 are arranged in a longitudinal end-to-end relationship.

The first section 28 includes at least one generally planar permanent magnet strip 32 and 34 disposed in the channel 26 and mounted to interior surfaces of the side and base walls 24 and 22, respectively, of the case 20 by suitable means such as an adhesive bonding agent. The permanent magnet strips 32 and 34 extend longitudinally and are generally rectangular in shape. The permanent magnet strips 32 have a height less than a height of the side walls 24 to allow an insulating strip (not shown) to be disposed on the edges thereof and a non magnetic membrane (not shown) to be stretched across the edges of the side walls 24. Preferably, a plurality or three (3) permanent magnet strips 34 are disposed between the permanent magnet strips 32 and adhered to each other and to the interior surface of the base wall 22 to obtain a predetermined height.

The permanent magnet strips 32 and 34 are arranged to collectively present a first common magnetic polarity facing the interior of the first section 28 of the channel 26. The permanent magnet strips 32 and 34 are arranged in the first section 28 to present their north (N) magnetic polarity facing toward the interior of the channel 26 and their south (S) magnetic polarity impressed on the case 20.

The second section 30 also includes at least one generally planar permanent magnet strip 36 and 38 disposed in the channel 26 and mounted to interior surfaces of the side and base walls 24 and 22, respectively, of the case 20 by suitable means such as an adhesive bonding agent. The permanent magnet strips 36 and 38 extend longitudinally and are generally rectangular in shape. The permanent magnet strips 36 and 38 are similar to the permanent magnet strips 32 and 34 and a plurality or three (3) permanent magnet strips 38 are adhered to each other and to the interior surface of the base wall 22. The permanent magnet strips 36 and 38 are arranged to collectively present a second common magnetic polarity facing the interior of the second section 30 of the channel 26. Preferably, the permanent magnet strips 36 and 38 are arranged in the second section 30 to present their south (S) magnetic polarity facing toward the interior of the channel 26 and their north (N) magnetic polarity impressed on the case 20.

The dual coil pick-up assembly 10 also includes a first coil assembly, generally indicated at 40, disposed in the first section 28 and a second coil assembly, generally indicated at 42, disposed in the second section 30. The first and second coil assemblies 40 and 42 include a pair-of core or frame pieces 44 and 46 having a general "C" shape. The core pieces 44 and 46 are made of a ferromagnetic material such as an iron based steel. The core pieces 44 and 46 are orientated in a back to back relationship. The first and second coil assemblies 40 and 42 also include at least one insulating spacer 48 disposed between the core pieces 44 and 46 to form a gap 50 therebetween such that the core pieces 44 and 46 do not directly contact each other. The core pieces 44 and 46 have a plurality of recesses 52 at exposed exterior edges thereof to define rows of tooth-like projections or teeth 54 for a function to be described.

The first coil assembly 40 further includes a conductive wire such as copper wrapped or wound around the core pieces 44 and 46 in a first direction to form a first pick-up coil 56. The first pick-up coil 56 has a pair of first leads 58 extending outwardly from one end of the channel 26. The second coil assembly 42 also includes a conductive wire such as copper wrapped or wound around the core pieces 44 and 46 in a second direction opposite to the first direction to form a second pick-up coil 60. The second pick-up coil 60 has a pair of second leads 62 extending outwardly from one end of the channel 26. The first and second leads 58 and 62 are connected together in series and to a socket (not shown) on the guitar 12 for connection to an amplifier and speaker system (not shown).

In operation, the first coil assembly 40 is disposed in the first section 28 of the channel 26 and mounted to the upper permanent magnet strip 34 by suitable means such as an adhesive bonding agent. The core pieces 44 and 46 of the first coil assembly 40 are magnetically polarized to the N polarity of the adjacent faces of the permanent magnet strips 32 and 34. Likewise, the second coil assembly 42 is disposed in the second section 30 of the channel 26 and spaced from the first coil assembly 40. The second coil assembly 42 is mounted on the upper permanent magnet strip 38 by suitable means such as an adhesive bonding agent. The core pieces 44 and 46 of the second coil assembly 42 are magnetically polarized to the S polarity of the adjacent faces of the strips 36 and 38. The recesses 52 between the adjacent teeth 54, together with the adjacent permanent magnet strips 32, 34 and 36, 38 thus define magnetic flux bottles or geometric flux shaping forms in each recess 52. Each recess 52, therefore, proximate its center forms effectively a vector source FS from which flux lines FL, in a radial fan out, extend to the nearest oppositely polarized side wall 24 as illustrated in FIG. 4.

When a string 18 moves the magnetic field, the flux pattern will change, thus inducing a voltage in the first pick-up coil 56 and second pick-up coil 60. Since the first and second pick-up coils 56 and 60 are wound in opposite directions around their respective core pieces 44 and 46 and connected together in series, the net signal from the dual coil pick-up assembly 10 is the sum of the signals in the first and second pick-up coils 56 and 60 and the hum in one of the coils 56, 60 cancels out that in the other.

Accordingly, the dual coil pick-up assembly 10 has an arrangement of two coils 56, 60 such that the hum in one of the coils cancels out that in the other, while the signals in each coil add together to produce a stronger signal. Also, the coils 56, 60 are arranged in a longitudinal end-to-end relationship, resulting in smaller coils assembled in one longitudinally extending case 20, making it less expensive to manufacture and assemble.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A pick-up assembly for a stringed musical instrument having a plurality of moveable strings comprising:

a case including means for forming a longitudinal channel;

at least one first magnet disposed in said longitudinal channel along an interior side of said channel forming means;

at least one coil means disposed in the interior of said longitudinal channel and having a vertical height less than a vertical height of the interior side of said channel forming means; and a plurality of second magnets disposed in the interior of said longitudinal channel and extending horizontally between an interior bottom of said channel forming means and said coil means such that an upper surface of said coil means is near an upper surface of the interior side of said channel forming means.

2. A pick-up assembly as set forth in claim 1 wherein said at least one first magnet is a generally planar permanent magnet strip.

3. A pick-up assembly as set forth in claim 2 wherein said permanent magnet strip extends longitudinally.

4. A pick-up assembly as set forth in claim 1 wherein said permanent magnet strip is rectangular in shape.

5. A pick-up assembly as set forth in claim 1 wherein said second magnets are planar permanent magnet strips.

6. A pick-up assembly as set forth in claim 2 wherein said permanent magnet strips extends longitudinally.

7. A pick-up assembly as set forth in claim 1 wherein said permanent magnet strips are rectangular in shape.

8. A pick-up assembly as set forth in claim 1 wherein said second magnets are stacked upon each other.

9. A pick-up assembly as set forth in claim 1 wherein said second magnets are adhered to each other.

10. A pick-up assembly as set forth in claim 1 wherein said first and second magnets have a first common magnetic polarity impressed on said case and a second common polarity facing toward the interior of said longitudinal channel.

11. A pick-up assembly as set forth in claim 1 wherein said case extends longitudinally and has a U-shape.

12. A pick-up assembly as set forth in claim 1 wherein said case has a planar base wall and a pair of planar side walls parallel to each other and perpendicular to said base wall to form said longitudinal channel.

13. A pick-up assembly as set forth in claim 1 wherein said case is made of a ferromagnetic material.

14. A pick-up assembly as set forth in claim 1 wherein said coil means comprises at least one core piece having a coil wrapped around said at least one core piece.

15. A pick-up assembly as set forth in claim 1 wherein said coil means comprises a plurality of core pieces extending longitudinally and a coil wrapped around said core pieces.

16. A pick-up assembly as set forth in claim 1 wherein said channel forming means comprises a base wall and a pair of side walls forming a U-shape.

17. A pick-up assembly for a stringed musical instrument having a plurality of moveable strings comprising:

a case having a longitudinal channel;

at least one first magnet disposed in said longitudinal channel along an interior side of said case;

at least one coil disposed in the interior of said longitudinal channel and having a vertical height less than a vertical height of the interior side of said case; and a plurality of second magnets disposed in the interior of said longitudinal channel and stacked horizontally between an interior bottom of said case and said coil such that an upper surface of said coil is near an upper surface of the interior side of said case.

18. A pick-up assembly as set forth in claim 1 wherein said second magnets are planar permanent magnet strips that extend longitudinally.

19. A pick-up assembly as set forth in claim 1 wherein said coil comprises at least one longitudinally extending core piece having conductive wire wrapped around said at least one core piece.

20. A pick-up assembly for a stringed musical instrument having a plurality of moveable strings comprising:

a base wall and a pair of side walls forming a U-shape and a longitudinal channel;

at least one first permanent magnet strip disposed in said longitudinal channel along each of said side walls;

a coil having plurality of core pieces extending longitudinally and conductive wire wrapped around said core pieces and disposed in the interior of said channel; and a plurality of second permanent magnet strips disposed in the interior of said longitudinal channel and stacked horizontally upon each other and disposed between said base wall and said coil such that an upper surface of said coil is near an upper surface of said side walls.

* * * * *